US007882687B2

(12) United States Patent
Blitstein et al.

(10) Patent No.: US 7,882,687 B2
(45) Date of Patent: Feb. 8, 2011

(54) COMPOSITE ALPACA YARN AND PROCESS FOR MAKING SAME

(76) Inventors: Joseph Frederic Blitstein, 1121 Crandon Blvd., PH E1208, Key Biscayne, FL (US) 33149; Yusef Luciano Mufarech-Bertello, Ave. Cajamarquilla 1085 Zarate, Lima (PE) L36

( * ) Notice: Subject to any disclaimer, the term of this patent is extended or adjusted under 35 U.S.C. 154(b) by 11 days.

(21) Appl. No.: 12/263,193

(22) Filed: Oct. 31, 2008

(65) Prior Publication Data

US 2009/0220784 A1 Sep. 3, 2009

Related U.S. Application Data

(63) Continuation-in-part of application No. 11/807,798, filed on Aug. 30, 2007, now abandoned.

(51) Int. Cl.
*D02G 3/02* (2006.01)

(52) U.S. Cl. ..... 57/252; 57/256

(58) Field of Classification Search ..... 57/252, 57/256, 333, 350

See application file for complete search history.

(56) References Cited

U.S. PATENT DOCUMENTS

| | | | |
|---|---|---|---|
| 27,877 | A | 4/1860 | Allen |
| 813,583 | A | 2/1906 | Potter |
| 2,016,387 | A | 4/1935 | Nutter |
| 2,260,229 | A | 10/1941 | Nutter et al. |
| 2,271,184 | A | 1/1942 | Dreyfus |
| 2,416,208 | A | 2/1947 | Oppenheim |
| 4,384,450 | A | 5/1983 | Sawyer |
| 4,466,237 | A | 8/1984 | Sawyer |
| 4,698,956 | A | 10/1987 | Clarke et al. |
| 5,481,864 | A | 1/1996 | Wright |
| 6,330,786 | B1 | 12/2001 | Settle |

*Primary Examiner*—Shaun R Hurley
(74) *Attorney, Agent, or Firm*—Albert Bordas

(57) ABSTRACT

Composite Alpaca yarn and a process for making same. The composite Alpaca yarn comprises special and unique characteristics created by blending long natural irregular Camelid fibers, such as Alpaca, with short synthetic fibers, or other natural fibers, in a combination determined by homogenization of fibers. The homogenization of fibers takes into account fiber lengths for twisting them with the use of high-pressure air blown nozzles, wherein Alpaca fiber is wrapped around an internal core. The face and surface of the composite Alpaca yarn, exhibit the fine characteristics of the Camelid fibers, including thermal isolation and impermeability, along with exceptional softness, wherein the Camelid fibers can be as fine as 18 microns.

20 Claims, 3 Drawing Sheets

COMPOSITE ALPACA YARN AND PROCESS FOR MAKING SAME

BACKGROUND OF THE INVENTION

1. Field of the Invention

The present invention relates to composite yarns, and more particularly, to composite Alpaca yarn and a process for making same.

2. Other Related Applications

The present application is a continuation-in-part of now abandoned U.S. patent application Ser. No. 11/807,798, filed on Aug. 30, 2007, which is hereby incorporated by reference.

3. Description of the Related Art

Alpaca are members of the biological family Camelidae, the only living family in the suborder Tylopoda. Camels, dromedaries, llamas, Alpacas, vicuñas, and guanacos are in this group. Camelidae are even-toed ungulates: they are classified in the Artiodactyla order. Other suborders of Artiodactyla include pigs, peccaries and hippos, suborder Suina, and the extraordinarily successful and diverse suborder Ruminantia, which includes cattle, goats, antelope and many others.

Fine fabrics are often desired, and especially yarns comprising characteristics of thermal isolation and impermeability along with exceptional softness.

Applicant believes that one of the closest references corresponds to U.S. Pat. No. 6,330,786 issued to Settle on Dec. 18, 2001 for Buffalo Hair Yarn and Fabric and Method of Making Buffalo Hair Yarn and Fabric. However, it differs from the present invention because Settle teaches a yarn comprising buffalo hair and wool that is commercially spun, in which the yarn has between about 5% to about 95% buffalo hair and between about 95% to about 5% fiber, and particularly has about 20% buffalo hair and about 80% fiber. The yarn is used to make fabric that can be used to make clothing, blankets, and other goods.

Applicant believes that another reference corresponds to U.S. Pat. No. 5,481,864 issued to Wright on Jan. 9, 1996 for Cloth Scrap Recycling Method. However, it differs from the present invention because Wright teaches a method for producing high quality fabrics using recycled fabric scraps by use of pre-gin contacting of the virgin carrier fibers, as well as moistening the fiber scraps that are recycled. Fiber length and uniformity percentages are maintained higher. The process has many advantages such as the need for re-dyeing the resulting material is minimized, and shrinkage is substantially reduced.

Applicant believes that another reference corresponds to U.S. Pat. No. 27,877 issued to Allen on Apr. 17, 1860 for Improvement in the Manufacture of Thread and Yarn. However, it differs from the present invention because Allen teaches a method in the production of threads or yarns from fibrous material by combining the slivers of cotton and wool with short fiber produced by reducing, the fiber of flax, hemp, jute, silk, or china-grass, or any other long-staple fiber that can be spun in the ordinary cotton and wool machinery.

Applicant believes that another reference corresponds to U.S. Pat. No. 813,583 issued to Potter on Feb. 27, 1906 for Yarn and Process of Making the Same. However, it differs from the present invention because Potter teaches a yarn and process of making the same that provide a yarn composed of fibers whose normal lengths are unequal, as of cotton and wool fibers, and to provide a method for making the yarn whereby the mixed fibers may be worked on ordinary cotton working machinery regardless of the proportionate quantity of wool fiber in the mixture.

Applicant believes that another reference corresponds to U.S. Pat. No. 2,016,387 issued to Nutter on Apr. 9, 1935 for Method of and Apparatus for Spinning a Single Ply Yarn Comprising a Blend of Animal and Vegetable Fibers. However, it differs from the present invention because Nutter teaches a spinning of a single-ply yarn from a mixture or blend of relatively long fibers, such as long animal fibers, and relatively short fibers such as short vegetable fibers.

Applicant believes that another reference corresponds to U.S. Pat. No. 2,260,229 issued to Nutter et al. on Oct. 21, 1941 for Method of Spinning Single Ply Yarn Comprising a Blend of Relatively Long Fibers and Relatively Short Fibers. However, it differs from the present invention because Nutter et al. teach relatively short fibers treated in usual manner to reduce them to the form of a roving, which is ready for the spinning operation. The roving of relatively short fibers is combined with the relatively long fibers during the last stage of the operation by which such relatively long fibers are being drafted and reduced to a roving form ready for the spinning operation.

Applicant believes that another reference corresponds to U.S. Pat. No. 2,271,184 issued to Dreyfus on Jan. 27, 1942 for Staple Fiber and Yarn. However, it differs from the present invention because Dreyfus teaches the preparation of spinnable mixtures of artificial staple fibers and spun yarns made of or containing such artificial staple fibers of such physical characteristics as to permit the successful spinning of the mixture of staple fibers into a yarn.

Applicant believes that another reference corresponds to U.S. Pat. No. 2,416,208 issued to Oppenheim on Feb. 18, 1947 for Yarn. However, it differs from the present invention because Oppenheim teaches yarns made of a mixture or blend of fibers and is concerned more particularly with a yarn, which may be employed in the production of knitted and woven fabrics which are of unusual and attractive appearance and extraordinary softness in hand and drape, and in some forms, have the quality of providing warmth without the weight normally necessary for that purpose. The yarn is made of a mixture in varying proportions of staple length synthetic fibers, wool, and animal fur. The animal fur being obtained of the mink, beaver, ermine, fox, nutria, opossum, sable, seal, muskrat, raccoon, or squirrel. Camel hair, and cashmere, llama, Alpaca, and angora fibers may also be employed but, if the staple lengths of such fibers are too long to permit them being handled on the cotton system, the staple lengths must be appropriately adjusted.

Applicant believes that another reference corresponds to U.S. Pat. No. 4,698,956 issued to Clarke, et al. on Oct. 13, 1987 for Composite Yarn and Method for Making the Same. However, it differs from the present invention because Clarke, et al. teach a continuous process of making a blended yarn of staple fiber and long-fiber or filamentary material in which the long-fiber or filamentary material is passed through a rupture zone to produce lengths thereof, which are fed directly into an air stream with the staple fibers to produce an intimate blend, which is conveyed by the air stream directly to an open end spinning device which produces the yarn.

Applicant believes that another reference corresponds to U.S. Pat. No. 4,384,450 issued to Sawyer on May 24, 1983 for Mixed Fiber Length Yarn. However, it differs from the present invention because Sawyer teaches a synthetic yarn, which comprises fibers of different lengths. At least three groups of synthetic fibers are present in the yarn, with the synthetic fibers within each group being substantially uniform in length. The substantially uniform length of each group of synthetic fibers present in the yarn differs from the substantially uniform length of the synthetic fibers in the other groups. The use of such mixtures of fiber lengths in a synthetic yarn enables the yarn to exhibit physical characteristics such as high bulk, which more closely resemble the characteristics of natural fiber-containing yarns. Fabrics having those physical characteristics may also be produced from the synthetic yarns disclosed.

Applicant believes that another reference corresponds to U.S. Pat. No. 4,466,237 issued to Sawyer on Aug. 21, 1984 for Mixed Fiber Length Yarn. However, it differs from the present invention because Sawyer teaches a synthetic yarn, which comprises fibers of different lengths. At least three groups of synthetic fibers are present in the yarn, with the synthetic fibers within each group being substantially uniform in length. The substantially uniform length of each group of synthetic fibers present in the yarn differs from the substantially uniform length of the synthetic fibers in the other groups. The use of such mixtures of fiber lengths in a synthetic yarn enables the yarn to exhibit physical characteristics such as high bulk, which more closely resemble the characteristics of natural fiber-containing yarns. Fabrics having those physical characteristics may also be produced from the synthetic yarns disclosed.

Other patents describing the closest subject matter provide for a number of more or less complicated features that fail to solve the problem in an efficient and economical way. None of these patents suggest the novel features of the present invention.

SUMMARY OF THE INVENTION

The instant invention is a composite Alpaca yarn and a process for making same. The composite Alpaca yarn is a yarn type created by the blending of long natural irregular Camelidae fibers, such as Alpaca, with short synthetic fibers or other natural fibers in a combination.

More specifically, the instant invention is a composite Alpaca yarn, comprising Alpaca fibers wrapped around an internal core. The internal core is made of synthetic fibers. The Alpaca fibers are from an Alpaca fibers. The synthetic fibers are made of micro fibers of polyester or cellulose. The Alpaca fibers make up an exterior face by covering up to approximately 20% of said internal core. The Alpaca fibers make up an exterior face by covering up to approximately 20% of the internal core. The internal core is made of fine micropolyester or a cellulose type. The Alpaca fibers make up an exterior face by covering up to approximately 20% of the internal core.

The process for making the composite Alpaca yarn, comprises the following steps:

A) stretching Alpaca fibers having an Alpaca top count of approximately of 0.025 Ne;

B) breaking the Alpaca fibers from long lengths to medium lengths;

C) collecting the medium lengths of the Alpaca fibers with a suction nozzle into a single fiber deposit;

D) mixing the medium lengths of the Alpaca fibers with the synthetic fibers;

E) carding the medium lengths of the Alpaca fibers and the synthetic fibers;

F) drawing the medium lengths of the Alpaca fibers and the synthetic fibers a first pass after the carding;

G) drawing the medium lengths of the Alpaca fibers and the synthetic fibers a second pass after the first pass;

H) drawing the medium lengths of the Alpaca fibers and the synthetic fibers a third pass after the second pass;

I) spinning the medium lengths of the Alpaca fibers and the synthetic fibers; and J) wrapping the medium lengths of the Alpaca fibers around the synthetic fibers to produce composite Alpaca yarn.

It is therefore one of the main objects of the present invention to provide composite Alpaca yarn and a process for making same, which provides homogenization of fibers, taking into account fiber lengths and twisting them using high pressure air blown nozzles.

It is another object of this invention to provide composite Alpaca yarn and a process for making same that allows the working of very fine yarns, up to a 120 metric count at speeds exceeding 200 meters a minute.

It is another object of this invention to provide composite Alpaca yarn and a process for making same, which surface exhibits the fine characteristics of the Camelidae, hair including thermal isolation and impermeability, along with exceptional softness.

It is another object of this invention to provide composite Alpaca yarn and a process for making same, wherein Alpaca fiber is wrapped around an internal core, which may be a fine micropolyester or a cellulose type such as "TENCEL".

It is another object of this invention to provide composite Alpaca yarn and a process for making same, which blend process provides strength, durability and allows for full machine washability, machine drying and complete anti wrinkling characteristics.

It is another object of this invention to composite Alpaca yarn and a process for making same that provides a non-pilling yarn, even though historically, natural Alpaca fibers had exhibited substantial pilling characteristics with limited strength, when blended with other fibers.

It is yet another object of this invention to provide such composite Alpaca yarn and a process for making same that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
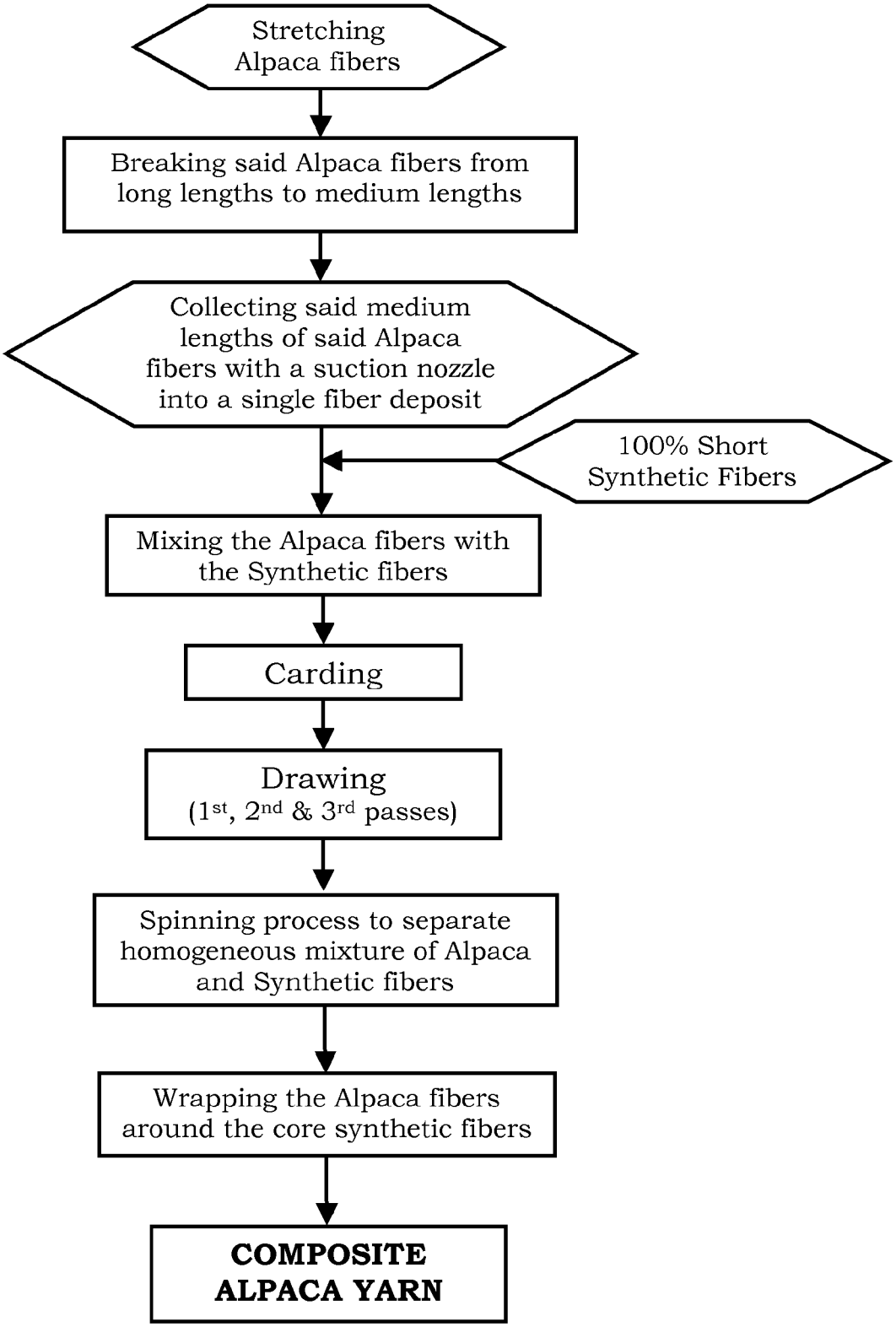
FIG. 1 is a first flow chart detailing a process for making composite Alpaca yarn.
Figure 2:
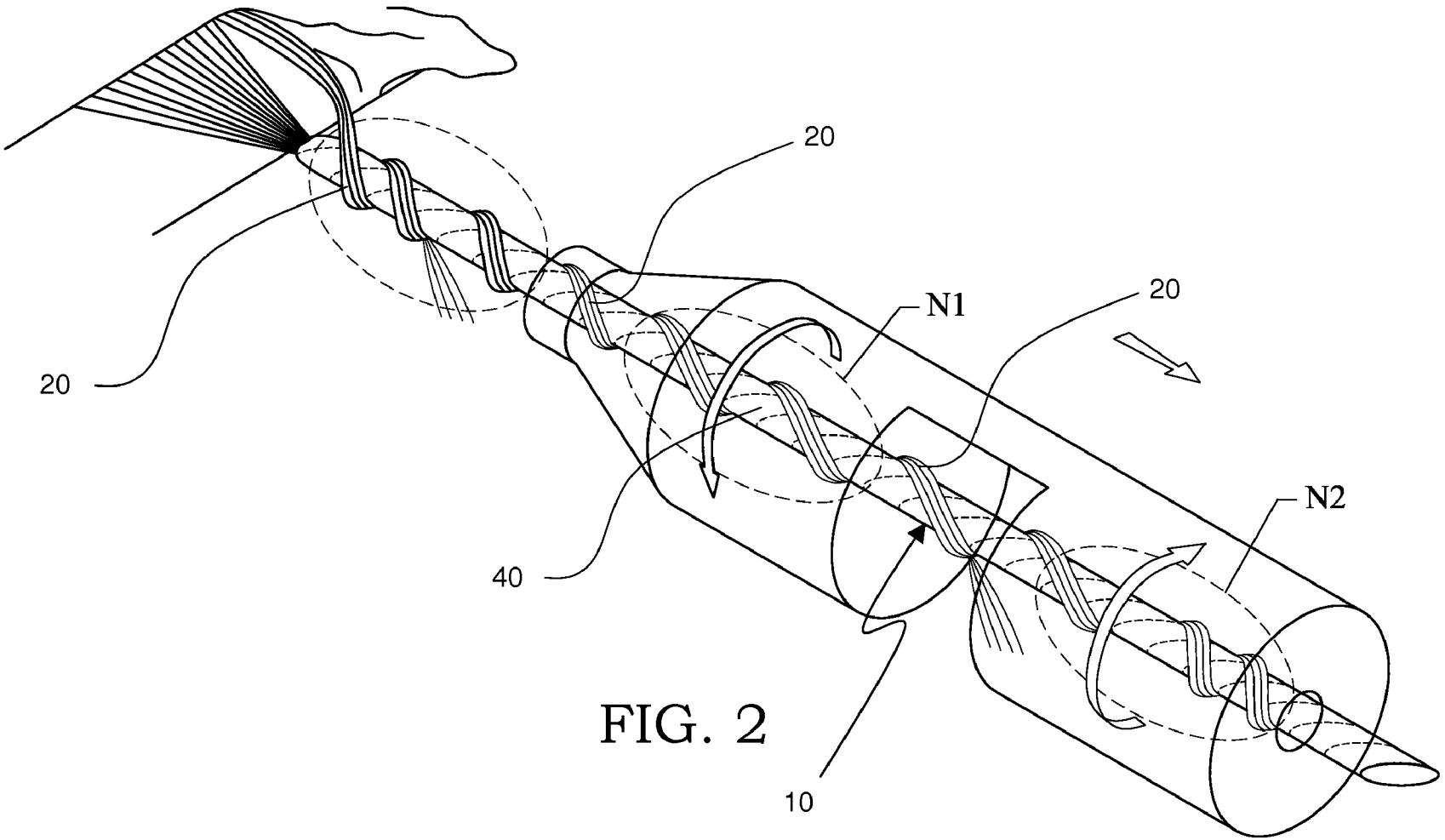
FIG. 2 is an illustration of spinning and wrapping of medium lengths of Alpaca fibers around an internal core to make composite Alpaca yarn.
Figure 3:
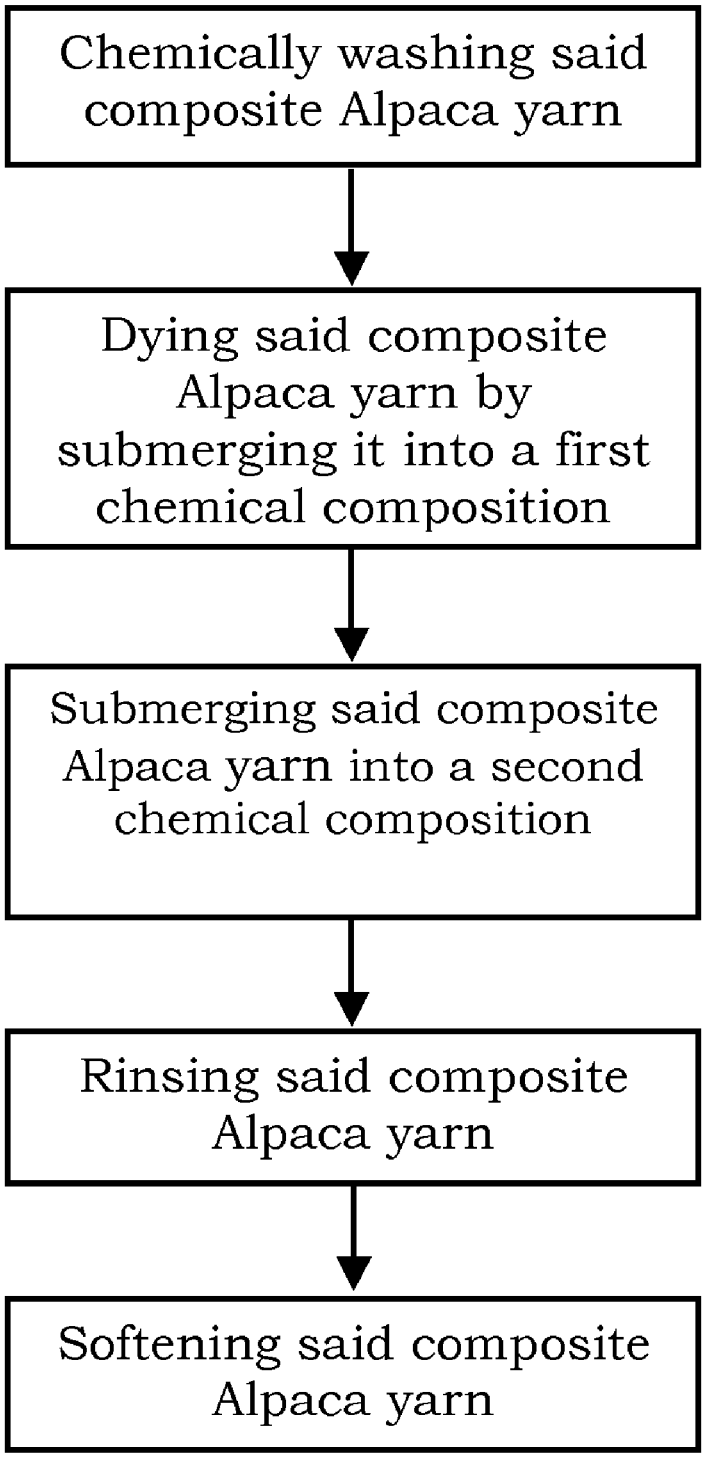
FIG. 3 is a second flow chart detailing the process for making composite Alpaca yarn.

As seen in FIGS. 1, 2, and 3, the instant invention comprises composite Alpaca yarn 10 and a process for making same. The composite Alpaca yarn 10 is defined as "ALPACOR", and it comprises special and unique characteristics created by blending long natural irregular Camelidae fibers, such as Alpaca, with short synthetic fibers, or other natural fibers, in a combination determined by homogenization of fibers. The homogenization of fibers takes into account fiber lengths for twisting them with the use of high-pressure air blown nozzles, wherein as seen in FIG. 2, Alpaca fibers 20 are wrapped around internal core 40, which may be a micropolyester, including recycled micropolyester, or a cellulose type such as cotton, "LYCRA", spandex, nylon, "TENCEL", or other fibers. The composite Alpaca yarn 10 retains a 100% outer lining of Camelidae fibers, in particular fine Alpaca. The face and surface of the composite Alpaca yarn 10, exhibit the fine characteristics of the Camelidae fibers, including thermal isolation and impermeability, along with exceptional softness, wherein the Camelidae fibers can be as fine as 18 microns. This allows the working of very fine yarns up to a 120 metric count at speeds exceeding 200 meters a minute.

When two dissimilar fibers are blended, the process must ensure durability of created fabrics for both wearability and washing. Historically, natural Camelidae fibers have exhibited substantial pilling with limited strength when previously blended with other fibers. However, an important characteristic of the present composite Alpaca yarn 10 is that its structure creates a non-pilling yarn. Extensive testing has demonstrated that the composite Alpaca yarn 10 development process utilizing Alpaca fibers 20, prevents the outer layer natural fiber from separating from the total yarn. With a blending process, the yarn does not lose its luster and softness after extensive use and machine washing. Alpaca fibers 20 cover up to 20% of internal core 40. Alpaca fibers 20 are all concentrated on the outer face of the composite Alpaca yarn 10 that can be utilized in the making of fabrics for apparel having strength and durability, and allows for machine washability and drying, and complete anti-wrinkling characteristics, which will not pill nor come apart after extensive use.

The composite Alpaca yarn 10 is a luxury fiber that can be made as fine as silk, 50 count on the cotton TN scale, or as thick as fleece, 20 count or less on the cotton TN scale. Weights of finished composite Alpaca yarn 10 fabrics range from 120 grams per $m^2$–380 grams per $m^2$. Alpaca fibers 20 are hollow and retain body heat regardless of the coldest temperatures. Because Alpaca fibers 20 are the outer face of the present composite Alpaca yarn 10, they remain closest to the skin when worn as a fabric, garment, or socks as an example. Therefore, the composite Alpaca yarn 10 creates a natural blanket effect regardless of the weight of the product being produced by it. In addition, the composite Alpaca yarn 10 retains the soft and luxurious hand of Camelidae fibers with their inherent characteristics. The composite Alpaca yarn 10 is naturally water repellent, and heat retentive regardless of weight and fabric finish. Furthermore, the composite Alpaca yarn 10 naturally wicks away from skin, and is naturally antimicrobial, whereby it does not retain odor. It is also naturally hypoallergenic, and is fully machine washable which softens with each wash. Furthermore, it has no loss of body shape, and has natural elasticity.

As seen in FIG. 1, the composite Alpaca yarn 10 and the process for making same, comprises the following steps:

A) stretching Alpaca fibers having an Alpaca top count of approximately of 0.025 Ne;

B) breaking said Alpaca fibers from long lengths of approximately 70 millimeters to medium lengths of approximately 38 millimeters;

C) collecting said medium lengths of said Alpaca fibers with a suction nozzle into a single fiber deposit;

D) mixing said medium lengths of said Alpaca fibers with said synthetic fibers;

E) carding said medium lengths of said Alpaca fibers and said synthetic fibers;

F) drawing said medium lengths of said Alpaca fibers and said synthetic fibers a first pass after said carding;

G) drawing said medium lengths of said Alpaca fibers and said synthetic fibers a second pass after said first pass;

H) drawing said medium lengths of said Alpaca fibers and said synthetic fibers a third pass after said second pass;

I) spinning said medium lengths of said Alpaca fibers and said synthetic fibers; and J) wrapping said medium lengths of said Alpaca fibers around said internal core.

With regard to step A) stretching Alpaca fibers having an Alpaca top count of approximately of 0.025 Ne, with a number of slivers equivalent to 1; in the preferred embodiment, stretching Alpaca fibers comprises drafting Alpaca fibers 6 times, having a front roller distance of approximately 50 mm, having a back roller distance of approximately 54 mm, at a speed of approximately 280 meters per minute.

With regard to step B) breaking said Alpaca fibers from long lengths to medium lengths; the Alpaca fibers are broken from long lengths to medium lengths. Long lengths are of approximately 70 millimeters and medium lengths are of approximately 38 millimeters. Raw Alpaca fiber, defined as the top, enters through said back rollers and is drafted at least 6 times.

With regard to step C) collecting said medium lengths of said Alpaca fibers with a suction nozzle into a single fiber deposit; a suction nozzle sucks in all the Alpaca fibers and collects them in a single fiber deposit.

With regard to step D) mixing said medium lengths of said Alpaca fibers with said synthetic fibers; the mixing occurs in a first machine.

With regard to step E) carding said medium lengths of said Alpaca fibers and said synthetic fibers; the carding of the Alpaca fibers and synthetic fibers occurs with the following machine settings: licker in speed of approximately 808 RPM, main cylinder speed of approximately 350 RPM, flat speed of approximately 150 mm/min, for a production of approximately 110 meters per minute, having a final count of 0.12 Ne, and said second machine adjusts automatically for a given sliver count.

With regard to step F) drawing said medium lengths of said Alpaca fibers and said synthetic fibers a first pass after said carding; the drawing is done on standard cotton draw frames with the following machine settings: back roller distance approximately 50 mm; front roller distance approximately 47 mm; placing 6 slivers of said medium lengths of said Alpaca fibers and said synthetic fibers together for them to be stretched; drafting said 6 slivers 6 times; having a speed of approximately 450 meters per minute; having a final count of 0.12 Ne, and said third machine does not adjust automatically for a given sliver count.

With regard to step G) drawing said medium lengths of said Alpaca fibers and said synthetic fibers a second pass after said first pass; the drawing is done on the standard cotton draw frames with the following machine settings: back roller distance approximately 48 mm; front roller distance approximately 45 mm; placing said 6 slivers together for them to be stretched; drafting said 6 slivers 6 times; having a speed of approximately 450 meters per minute; having a final count of approximately 0.12 Ne, and said fourth machine adjusts automatically for a given sliver count.

With regard to step H) drawing said medium lengths of said Alpaca fibers and said synthetic fibers a third pass after said second pass; the drawing is done on the standard cotton draw frames with the following machine settings: back roller distance approximately 46 mm; front roller distance approximately 43 mm; placing 3 slivers of said medium lengths of said Alpaca fibers and said synthetic fibers together for them to be stretched; drafting said 3 slivers 6.5 times; having a speed of approximately 450 meters per minute; having a final count of approximately 0.26 Ne, and said fifth machine adjusts automatically for a given sliver count.

With regard to step I) spinning said medium lengths of said Alpaca fibers and said synthetic fibers; the spinning is performed by air jet spinning to separate most of said Alpaca fibers from said synthetic fibers by centrifugal forces.

An air jet spinning mechanism comprises three drafting zones, and two air jet nozzles, defined as N1 and N2, that are aligned in opposite directions. The air jet spinning is done with the following machine settings: top rollers are set as follows: back: 43 mm; middle: 43 mm; and front: 48.5 mm. Bottom rollers are set as follows: back: 45 mm; middle: 41.5 mm; and front: 44 mm. Air pressures are set as follows: Nozzle 1: 3.0 $Kg/cm^2$; and Nozzle 2: 5.5 $Kg/cm^2$. The Condenser is set at 2 mm and drafting said composite Alpaca yarn approximately 196.3 times; and a Main Draft: 35.8. Nozzle—Front Roller distance: 38-5 mm; Feed Ratio: 0.98; Speed: 247 meters per minute; and Final count: 50/1 Ne.

With regard to step J) wrapping said medium lengths of said Alpaca fibers around said synthetic fibers to produce composite Alpaca yarn; the wrapping is performed by said air jet spinning to wrap said Alpaca fibers around said synthetic fibers to produce the composite Alpaca yarn as seen in FIG. 2.

Internal core 40 is made of synthetic fibers, and may be a fine micropolyester, including recycled micropolyester, or a cellulose type such as cotton, "LYCRA", spandex, nylon, "TENCEL", or other fibers. As mentioned before, it is noted that Alpaca fibers 20 cover up to 20% of internal core 40. Therefore, approximately 80% of internal core 40 is exposed and not covered by Alpaca fibers 20, as seen in FIG. 2. It is noted that wrapping the medium lengths of the Alpaca fibers around internal core 40 is what creates the main characteristics of strength, and minimal or no pilling, depending upon the final knitted or woven product.

The process of making composite Alpaca yarn 10 further comprises the dying of multiple fibers with different dying temperature levels. In the composite Alpaca yarn 10, each fiber has its own ideal temperature for color acceptance. Nevertheless, a dying process has been developed for composite Alpaca yarn 10, allowing for it to be dyed at a common temperature to create a single color. Using the Alpaca fiber as the primary natural fiber, fabrics can be created with solid colors as well as a mélange. The composite Alpaca yarn 10 maintains a strong color fastness after the first machine wash, regardless of the water temperature used in the washing process.

Natural fibers from the Camelidae family, such as Alpaca, require a lesser temperature level for dying than man-made synthetic fibers such as micropolyester. In order to create a single color during a single dying process of natural and synthetic fibers, protection must be given to the natural fibers so that they will not be severely damaged and or eliminated when dying the multiple fibers at synthetic fiber temperature requirements. Normally a Camelidae fiber can be dyed at 92° C. Micropolyester would normally be dyed at 128° C. The dying process utilized for the composite Alpaca yarn 10 accomplishes a unified color at approximately 100° C. At this temperature utilizing a specific chemical process, the Camelidae—Alpaca fiber is retained.

As seen in FIG. 3, the composite Alpaca yarn 10 and the process for making same, further comprises the following step:

K) chemically washing said composite Alpaca yarn.

The composite Alpaca yarn 10 and the process for making same, further comprises the following steps:

L) dying said composite Alpaca yarn by submerging it into a first chemical composition for 60 minutes at 108° C.-118° C.; and M) submerging said composite Alpaca yarn into a second chemical composition for 60 minutes at 108° C.-118° C.

With regard to steps J) and K), it is noted that the temperatures are reduced to approximately 90° C. in the event that internal core 40 is cellulose-type fibers such as "TENCEL".

The composite Alpaca yarn 10 and the process for making same, further comprises the following step:

N) rinsing said composite Alpaca yarn by submerging it into a third chemical composition for 20 minutes at 60° C. to remove any excess dying materials that may not have been absorbed by said composite Alpaca yarn 10.

The composite Alpaca yarn 10 and the process for making same, further comprises the following step:

j) softening said composite Alpaca yarn.

It is noted that the above times and temperatures are approximated and may vary. Natural fiber and natural fiber blend fabrics and socks usually are washed by hand or by dry cleaning to minimize shrinking and pilling. Fabrics and socks created from composite Alpaca yarn 10 can be fully machine washed and dried with minimum shrinkage and no pilling. Repeated washing only softens the fabrics and the socks. They do not lose loft and luster even after repeated washing. Loft is defined as the properties of firmness, resilience and bulk of fiber batting. The composite Alpaca yarn 10 only enhances the original properties of each component fiber.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. Composite Alpaca yarn, comprising Alpaca fibers wrapped around an internal core, said internal core is made primarily of synthetic fibers, said Alpaca fibers are from an Alpaca, and said synthetic fibers are made of micro fibers of polyester or cellulose, said Alpaca fibers make up an exterior face by covering up to approximately 20% of said internal core.

2. A process for making the composite Alpaca yarn set forth in claim 1, comprising the following steps:

A) stretching Alpaca fibers having an Alpaca top count of approximately of 0.025 Ne;

B) breaking said Alpaca fibers from long lengths of approximately 70 millimeters to medium lengths of approximately 38 millimeters;

C) collecting said medium lengths of said Alpaca fibers with a suction nozzle into a single fiber deposit;

D) mixing said medium lengths of said Alpaca fibers with said synthetic fibers;

E) carding said medium lengths of said Alpaca fibers and said synthetic fibers;

F) drawing said medium lengths of said Alpaca fibers and said synthetic fibers a first pass after said carding;

G) drawing said medium lengths of said Alpaca fibers and said synthetic fibers a second pass after said first pass;

H) drawing said medium lengths of said Alpaca fibers and said synthetic fibers a third pass after said second pass;

I) spinning said medium lengths of said Alpaca fibers and said synthetic fibers; and J) wrapping said medium lengths of said Alpaca fibers around said internal core.

3. The process for making the composite Alpaca yarn set forth in claim 2, further characterized in that in said Step A)

said stretching Alpaca fibers comprises drafting said Alpaca fibers 6 times, having a front roller distance of approximately 50 mm, having a back roller distance of approximately 54 mm, at a speed of approximately 280 meters per minute.

4. The process for making the composite Alpaca yarn set forth in claim 2, further characterized in that in said Step B) said Alpaca fibers are broken from said long lengths to said medium lengths, whereby raw said Alpaca fibers, enters through said back rollers and is drafted at least 6 times.

5. The process for making the composite Alpaca yarn set forth in claim 2, further characterized in that in said Step D) said mixing of said Alpaca fibers and said synthetic fibers occurs in a first machine.

6. The process for making the composite Alpaca yarn set forth in claim 5, further characterized in that in said Step E) said carding of said Alpaca fibers and said synthetic fibers occurs with a second machine having settings of licker in speed approximately 808 RPM, main cylinder speed of approximately 350 RPM, flat speed of approximately 150 mm/min, for a production of approximately 110 meters per minute, having a final count of approximately 0.12 Ne, and said second machine adjusts automatically for a given sliver count.

7. The process for making the composite Alpaca yarn set forth in claim 6, further characterized in that in said Step F) said drawing is done on standard cotton draw frames with a third machine having settings of back roller distance approximately 50 mm; front roller distance approximately 47 mm; placing 6 slivers of said medium lengths of said Alpaca fibers and said synthetic fibers together for them to be stretched; drafting said 6 slivers 6 times; having a speed of approximately 450 meters per minute; having a final count of approximately 0.12 Ne, and said third machine does not adjust automatically for a given sliver count.

8. The process for making the composite Alpaca yarn set forth in claim 7, further characterized in that in said Step G) said drawing is done on said standard cotton draw frames with a fourth machine having settings of back roller distance approximately 48 mm; front roller distance approximately 45 mm; slivers together for them to be stretched; having a total draft of 6 drafting said 6 slivers 6 times; having a speed of approximately 450 meters per minute; having a final count of approximately 0.12 Ne, said fourth machine adjusts automatically for a given sliver count.

9. The process for making the composite Alpaca yarn set forth in claim 8, further characterized in that in said Step H) said drawing is done on said standard cotton draw frames with a fifth machine having settings of back roller distance approximately 46 mm; front roller distance approximately 43 mm; placing 3 slivers of said medium lengths of said Alpaca fibers and said synthetic fibers together for them to be stretched; drafting said 3 slivers 6.5 times; having a speed of approximately 450 meters per minute; having a final count of approximately 0.26 Ne, and said fifth machine adjusts automatically for a given sliver count.

10. The process for making the composite Alpaca yarn set forth in claim 9, further characterized in that in said Step I) said spinning is performed by air jet spinning to separate most of said Alpaca fibers from said synthetic fibers by centrifugal forces.

11. The process for making the composite Alpaca yarn set forth in claim 10, further characterized in that in said Step J) said wrapping is performed by said air jet spinning to wrap said Alpaca fibers around said synthetic fibers to produce aid composite Alpaca yarn, whereby said air jet spinning mechanism comprises three drafting zones, and two air jet nozzles that are aligned in opposite directions.

12. The process for making the composite Alpaca yarn set forth in claim 11, further characterized in that said air jet spinning is done with a sixth machine having settings of top rollers as back: approximately 43 mm; middle: approximately 43 mm; and front: approximately 48.5 mm, bottom rollers are set as back: approximately 45 mm; middle: approximately 41.5 mm; and front: approximately 44 mm, air pressures are set as Nozzle 1: 3.0 $Kg/cm^2$; and Nozzle 2: 5.5 $Kg/cm^2$, a condenser is set at approximately 2 mm and drafting said composite Alpaca yarn approximately 196.3 times; and a Main Draft approximately 35.8 mm; Nozzle—Front Roller distance approximately 38.5 mm; Feed Ratio approximately 0.98; Speed approximately 247 meters per minute; and Final count approximately 50/1 Ne.

13. A process for making Composite Alpaca yarn comprising Alpaca fibers wrapped around an internal core, said internal core is made primarily of synthetic fibers, said Alpaca fibers make up an exterior face by covering up to approximately 20% of said internal core, comprising the following steps:

A) stretching Alpaca fibers having an Alpaca top count of approximately of 0.025 Ne, said stretching Alpaca fibers comprises drafting said Alpaca fibers 6 times, having a front roller distance of approximately 50 mm, having a back roller distance of approximately 54 mm, at a speed of approximately 280 meters per minute;

B) breaking said Alpaca fibers from long lengths of approximately 70 millimeters to medium lengths of approximately 38 millimeters, whereby said Alpaca fibers are broken from said long lengths to said medium lengths, whereby raw said Alpaca fibers, enters through said back rollers and is drafted at least 6 times;

C) collecting said medium lengths of said Alpaca fibers with a suction nozzle into a single fiber deposit;

D) mixing said medium lengths of said Alpaca fibers with said synthetic fibers;

E) carding said medium lengths of said Alpaca fibers and said synthetic fibers;

F) drawing said medium lengths of said Alpaca fibers and said synthetic fibers a first pass after said carding;

G) drawing said medium lengths of said Alpaca fibers and said synthetic fibers a second pass after said first pass;

H) drawing said medium lengths of said Alpaca fibers and said synthetic fibers a third pass after said second pass;

I) spinning said medium lengths of said Alpaca fibers and said synthetic fibers; and J) wrapping said medium lengths of said Alpaca fibers around said internal core.

14. The process for making the composite Alpaca yarn set forth in claim 13, further characterized in that in said Step D) said mixing of said Alpaca fibers and said synthetic fibers occurs in a first machine.

15. The process for making the composite Alpaca yarn set forth in claim 14, further characterized in that in said Step E) said carding of said Alpaca fibers and said synthetic fibers occurs with a second machine having settings of licker in speed approximately 808 RPM, main cylinder speed of approximately 350 RPM, flat speed of approximately 150 mm/min, for a production of approximately 110 meters per minute, having a final count of approximately 0.12 Ne, and said second machine adjusts automatically for a given sliver count.

16. The process for making the composite Alpaca yarn set forth in claim 15, further characterized in that in said Step F) said drawing is done on standard cotton draw frames with a third machine having settings of back roller distance approximately 50 mm; front roller distance approximately 47 mm;

placing 6 slivers of said medium lengths of said Alpaca fibers and said synthetic fibers together for them to be stretched; drafting said 6 slivers 6 times; having a speed of approximately 450 meters per minute; having a final count of approximately 0.12 Ne, and said third machine does not adjust automatically for a given sliver count.

17. The process for making the composite Alpaca yarn set forth in claim 16, further characterized in that in said Step G) said drawing is done on said standard cotton draw frames with a fourth machine having settings of back roller distance approximately 48 mm; front roller distance approximately 45 mm; placing said 6 slivers together for them to be stretched; drafting said 6 slivers 6 times; having a speed of approximately 450 meters per minute; having a final count of approximately 0.12 Ne, and said fourth machine adjusts automatically for a given sliver count.

18. The process for making the composite Alpaca yarn set forth in claim 17, further characterized in that in said Step H) said drawing is done on said standard cotton draw frames with a fifth machine having settings of back roller distance approximately 46 mm; front roller distance approximately 43 mm; placing 3 slivers of said medium lengths of said Alpaca fibers and said synthetic fibers together for them to be stretched; drafting said 3 slivers 6.5 times; having a speed of approximately 450 meters per minute; having a final count of approximately 0.26 Ne, and said fifth machine adjusts automatically for a given sliver count.

19. The process for making the composite Alpaca yarn set forth in claim 18, further characterized in that in said Step I) said spinning is performed by air jet spinning to separate most of said Alpaca fibers from said synthetic fibers by centrifugal forces, and further characterized in that in said Step J) said wrapping is performed by said air jet spinning to wrap said Alpaca fibers around said synthetic fibers to produce said composite Alpaca yarn, whereby said air jet spinning mechanism comprises three drafting zones, and two air jet nozzles that are aligned in opposite directions.

20. The process for making the composite Alpaca yarn set forth in claim 19, further characterized in that said air jet spinning is done with a sixth machine having settings of top rollers as back: approximately 43 mm; middle: approximately 43 mm; and front: approximately 48.5 mm, bottom rollers are set as back: approximately 45 mm; middle: approximately 41.5 mm; and front: approximately 44 mm, air pressures are set as Nozzle 1: 3.0 $Kg/cm^2$; and Nozzle 2: 5.5 $Kg/cm^2$, a condenser is set at approximately 2 mm and drafting said composite Alpaca yarn approximately 196.3 times; and a Main Draft approximately 35.8 mm; Nozzle—Front Roller distance approximately 38.5 mm; Feed Ratio approximately 0.98; Speed approximately 247 meters per minute; and Final count approximately 50/1 Ne.

* * * * *